US008893400B2

(12) United States Patent
Carme

(10) Patent No.: US 8,893,400 B2
(45) Date of Patent: Nov. 25, 2014

(54) HAIR DRYER HAVING A PASSIVE SILENCER SYSTEM

(75) Inventor: Christian Carme, Marseilles (FR)

(73) Assignee: Technofirst, Aubagne Cedex (FR)

( * ) Notice: Subject to any disclaimer, the term of this patent is extended or adjusted under 35 U.S.C. 154(b) by 0 days.

(21) Appl. No.: 13/516,337

(22) PCT Filed: Dec. 17, 2010

(86) PCT No.: PCT/FR2010/052775

§ 371 (c)(1),
(2), (4) Date: Jun. 28, 2012

(87) PCT Pub. No.: WO2011/073585

PCT Pub. Date: Jun. 23, 2011

(65) Prior Publication Data

US 2012/0266484 A1 Oct. 25, 2012

(30) Foreign Application Priority Data

Dec. 18, 2009 (FR) ..... 09 59217

(51) Int. Cl.
*A45D 20/12* (2006.01)
*A45D 20/42* (2006.01)

(52) U.S. Cl.
CPC ..... *A45D 20/42* (2013.01); *A45D 20/12* (2013.01)
USPC ..... 34/97; 34/100; D28/18; 132/115; 338/202; 392/385

(58) Field of Classification Search
USPC ..... 34/95, 96, 97, 99, 100; D28/13, 18, 73; 132/212, 115, 118; 338/202, 184, 162, 338/172; 392/384, 385
See application file for complete search history.

(56) References Cited

U.S. PATENT DOCUMENTS 2,461,689 A * 2/1949 Kveton ..... 34/99
3,168,382 A * 2/1965 Chambers et al. ..... 34/99

(Continued)

FOREIGN PATENT DOCUMENTS

CN 1251747 A 5/2000
CN 101378676 A 3/2009

(Continued)

OTHER PUBLICATIONS

Chinese Office Action dated Jun. 26, 2014 from the corresponding Chinese application.

(Continued)

*Primary Examiner* — Steve M Gravini
(74) *Attorney, Agent, or Firm* — Lucas & Mercanti, LLP

(57) ABSTRACT

The invention relates to a hair dryer including a tapered plastic shell between a rear end and a front end through which flows out the air set into motion and heated by the hair dryer, this plastic shell defining at least one air inlet and an air outlet and being intended to accommodate at least one motor and one fan, the shaft of which is borne by an attached internal structure in the central portion of the fuselage. According to the invention, the plastic shell is conformed in order to receive the air between the air inlet and the internal structure bearing the fan, on a longer acoustic path as compared with the length of the acoustic path between the rear end and the internal structure bearing the fan.

11 Claims, 3 Drawing Sheets

(56) References Cited

U.S. PATENT DOCUMENTS

| | | | | |
|---|---|---|---|---|
| 4,196,343 | A * | 4/1980 | Han | 392/385 |
| 4,409,998 | A * | 10/1983 | Bauer | 132/227 |
| 5,444,215 | A | 8/1995 | Bauer | |
| 5,875,562 | A * | 3/1999 | Fogarty | 34/97 |
| 2003/0079366 | A1 * | 5/2003 | Chang | 34/96 |
| 2004/0231180 | A1 * | 11/2004 | Tang et al. | 34/96 |
| 2006/0080857 | A1 * | 4/2006 | Regen | 34/96 |
| 2008/0172900 | A1 * | 7/2008 | Ceva | 34/96 |
| 2009/0188126 | A1 | 7/2009 | Gaillard | |
| 2010/0212177 | A1 * | 8/2010 | Chen | 34/97 |
| 2011/0162225 | A1 * | 7/2011 | Obermann et al. | 34/97 |
| 2012/0102775 | A1 * | 5/2012 | Choi | 34/98 |
| 2012/0266484 | A1 * | 10/2012 | Carme | 34/97 |

FOREIGN PATENT DOCUMENTS

| | | | | |
|---|---|---|---|---|
| DE | 3202180 | A1 * | 8/1983 | A45D 20/44 |
| DE | 83 29 606 | U1 | 1/1984 | |
| DE | 88 05 910 | U1 | 6/1988 | |
| DE | 8805910 | U1 | 6/1988 | |
| EP | 362519 | A2 * | 4/1990 | A44C 5/00 |
| EP | 0993788 | A2 | 4/2000 | |
| EP | 2 002 752 | | 12/2008 | |
| GB | 2181311 | A * | 4/1987 | H05B 1/02 |
| JP | 42-17299 | U | 10/1967 | |
| JP | 52120058 | A * | 10/1977 | A45D 20/10 |
| JP | 55-124203 | U | 2/1979 | |
| JP | 54-040755 | | 3/1979 | |
| JP | 59-111605 | U | 7/1984 | |
| JP | H04503915 | A | 7/1992 | |
| JP | 2000-298487 | A | 10/2000 | |
| WO | WO 8908414 | A1 * | 9/1989 | A45D 20/12 |
| WO | 2007/123333 | A1 | 11/2007 | |
| WO | 2009-112690 | | 9/2009 | |

OTHER PUBLICATIONS

English translation of D1, Jun. 26, 2014.
Japanese Office action dated Jun. 10, 2014 from the corresponding Japanese application.
English translation of D3, Jun. 10, 214.

* cited by examiner

HAIR DRYER HAVING A PASSIVE SILENCER SYSTEM

CROSS-REFERENCE TO RELATED APPLICATIONS

This application is a 371 of PCT/FR2010/052775 filed Dec. 17, 2010, which in turn claims the priority of FR 0959217 filed Dec. 18, 2009, the priority of both applications is hereby claimed and both applications are incorporated by reference herein.

BACKGROUND OF THE INVENTION

The present invention relates to the general field of hair dryers.

Typically, a hair dryer includes a tapered plastic shell between a rear end and a front end through which flows out the air set into motion and heated inside the hair dryer. The plastic shell thus defines at least one air inlet and one air outlet and is intended to accommodate at least one motor and one fan. Generally, the axis of the fan is borne by an internal structure attached in the central portion of the fuselage. It is known that operation of a hair dryer generates several types of noises among which are the noise related to the flow of the air flux and the noise related to the operation of the turbine used for generating the air flow.

A hair dryer thus comprises several sound sources respectively related to the turbulences of the flow of the hot air flux, to the noise of the turbine, in particular the rotation of the blades and to the noise related to the vibration of the motor coupled with the shell of the hair dryer.

As regards the noise source corresponding to the flow noise of the flux related to turbulences, it is observed that the observed turbulences are of any dimensions. This results in a noise having a rich wide band spectrum both in low and medium frequencies and in high frequencies.

As regards the noise related to the turbine, it consists of sound lines correlated with the speed of rotation of the turbine and with the number of its blades. Finally, the sound spectrum related to the vibration of the motor/shell connection is also a noise with spectral lines.

Thus, more specifically, the invention is interested in the use of an acoustic silencer within a hair dryer, this acoustic silencer giving the possibility of obtaining passive sound reduction, notably on the noise related to the air flow and in part on the noise related to the turbine.

Passive sound reduction devices are known in other fields. These devices use foams or else rock wool or glass baffles. These means may contribute to reducing a portion of the noise generated by the operation of the turbine, generally only the high frequency spectral portion, but it is found that these means are unsuitable for treating air flow noises.

In addition to this, it is not possible to use this kind of solution inside a hair dryer since there are risks of detaching particles from the acoustic material which cannot be contemplated from the point of view of health.

Inside hair dryers, the use of an acoustic grid at the air inlet usually placed at the rear end of a tapered plastic shell embodying the hair dryer, is thus known.

The fineness of the screen of this grid allows a certain number of sound frequencies to be filtered. Such a grid notably reduces the high pitch whistling sound of the turbine.

The major defect of such an acoustic grid is that it forms a significant obstacle to the air flow. Sound reduction is thus achieved at the expense of a detrimental pressure drop within the flow since the consequent pressure drop resulting from this is expressed by a loss of efficiency of the hair dryer. The hair dryer then produces less heated air for a given electric power.

Further, the acoustic grid only allows treatment of the noise on the air inlet. The noise transmitted by the air flow and the turbine to the outlet is therefore not considered.

Thus, existing solutions for reducing the noise, either cannot be installed inside a hair dryer for reasons of health or for reasons of ageing of the materials, or generate significant pressure drops destroying the efficiency of the hair dryer.

OBJECT AND SUMMARY OF THE INVENTION

The main object of the present invention is therefore to overcome the drawbacks encountered in the known passive sound reduction solutions and to allow the implementation of passive sound reduction inside a hair dryer by proposing a hair dryer including a tapered plastic shell between a rear end and a front end through which flows out the air set into motion and heated by the hair dryer, this plastic shell defining at least one air inlet and one air outlet and being intended to accommodate at least one motor and one fan, the axis of which is borne by an attached internal structure in the central portion of the fuselage, characterized in that the plastic shell is conformed in order to receive the air between the air inlet and the internal structure bearing the fan on a longer acoustic path as compared with the length of the acoustic path between the rear end and the internal structure bearing the fan.

The invention therefore suggests providing the hair dryer, by conformation of its shell, with a path between the air inlet and the internal structure bearing the fan with a length greater than the observed physical distance between the rear end of the hair dryer and the internal structure bearing the fan.

The invention is therefore interested in treating with priority the noise conveyed by the fluid before the noise radiated by the shell. Indeed, it should be noted that the noise is globally conveyed by the displacement of air in the cowl which is necessarily open at a first end in order to let through air and open at the other end for letting it out. The noise thus exits preferentially through these apertures. By treating the thereby conveyed noise, the noise is also treated in a more global way.

Also, by extending the path covered by the air flow by means of a specific conformation of the plastic shell itself, an increased distance from the sound source to the ear of the user is ensured. Actually, even if the sound source is totally distributed in the fuselage, extending the flow path gives the possibility that the user will no longer directly hear an airflow and a turbine. This artificially moves the noise away from his/her ears. In acoustics, moving a sound source away amounts to decreasing its intensity by a factor of 1/r, r being the distance.

As this acoustic moving-away is achieved by means of a certain conformation of the plastic shell at the air inlet as far as the internal structure supporting the fan and/or the shaft of the fan and not by means of an acoustic grid cutting the flow, sound reduction is allowed with as less pressure drop as possible.

The sound reduction related to the use of such a passive silencer consisting of using a plastic shell of the cowl type for obtaining a reduction of the acoustic radiation of the turbulences related to the flow of the hot air flux as well as of the turbine used for generating this air flow, gives the possibility of processing the noises emitted in the spectral range comprising medium frequencies and high frequencies.

By calculating a conformation of the passive cowl so that the observed pressure drops are as low as possible, a reduction in the thermal efficiency of the appliance is avoided while reducing the noise generated by the operation of the turbine and by the presence of air flow turbulences.

In a first embodiment, the air inlet is found at the distal end of a handle forming a lateral projection on the fuselage of the shell.

This first particularly simple embodiment simply allows extension of the acoustic path covered by the air, by means of the length of the handle. In such an embodiment, quasi no pressure drop is observed. Further, this embodiment is particularly inexpensive. Nevertheless the attenuation of the noise is modest.

In another embodiment, as the air inlet is placed at the rear end of the fuselage, a baffle is conformed, between the air inlet and an internal space preceding the internal structure bearing the fan, by specifically molding a profile forming a lip with rotational symmetry on the internal face of the fuselage and by specifically molding a baffle front also with rotational symmetry, with a profile mating the profile of the lip and occupying the central orifice of the rear end of the fuselage and borne by the internal structure supporting the shaft of the fan.

This embodiment by the presence of the baffle front, gives the possibility of protecting the user from the operation of the turbine, further extending the acoustic path covered by the air. This embodiment therefore gives the possibility of doing without the presence of a protective grid at the rear end of the fuselage.

It is important to note here that a flow should be as laminar as possible for avoiding problems of flow. The least irregularity or shape of the convergence/divergent type generates turbulences. When turbulences are generated, then « the explosion of vortices» generates noise. The size of the vortices is correlated with the emitted frequencies: the bigger they are and more they generate low frequencies. Profiling the air flows according to the embodiment of the invention using a baffle and to the following embodiments, reduces vortices and improves acoustics in addition to extending the distance. It is the combined effect of both of these principles which improves the acoustics of the hair dryer.

In a preferential embodiment, the lip is molded on the internal face of the fuselage, turned towards the front of the fuselage, in order to urge air to abut in a ring-shaped bottom made on the baffle front mating the shape of the lip, the profile of the baffle front mating the profile of the lip subsequently causing air to circulate towards the rear of the fuselage so that it comes into contact with the ring-shaped bottom of the lip located at the periphery of the latter at the connection of the lip to the fuselage before air is again propelled forwards inside the internal space, also called a suction chamber, preceding the internal structure bearing the fan.

Advantageously, the baffle front borne by the internal structure, includes a so-called suspension chamber in which the motor is placed.

Such an embodiment consists of placing the turbine on the passive suspension which is the actual baffle front. Indeed, the latter is borne in a suspended way by the structure bearing the fan. This allows it to absorb the vibrations of the motor by being used as a suspension for the latter.

Still more advantageously, the damping frequency proposed for the suspension of the baffle front is adjusted so as to absorb the vibration frequency of the turbine and reduce the vibratory transmission of the turbine onto the shell of the hair dryer. The fluid/structure coupling is therefore reduced and the shell no longer radiates. Nevertheless it is noted that even when the damping frequency is adjusted, the passive suspension of the turbine only allows optimum treatment of a single speed of rotation of the latter. Advantageously, the optimization of the suspension will be achieved for the noisiest speed of rotation.

According to a third embodiment, at least one spiral is pierced in a plastic material cap embodying the rear of the fuselage, this spiral opening out into an internal space preceding the internal structure bearing the fan, the inlet of the spiral being the air inlet of the hair dryer.

If the size of the spiral is calculated in a suitable way, such an embodiment gives the possibility of retaining a low pressure drop. This embodiment also provides good protection of the user at the air inlet without it being worthwhile to add any protective grid.

Advantageously, at least two spirals are pierced in the cap and open out in the internal space, the inlets of the spirals being the air inlet of the hair dryer.

Such a preferential embodiment allows the use of the spiral channels with a smaller diameter while ensuring the absence of any pressure drop or a low pressure drop.

In a fourth embodiment, the air inlet is made on the periphery of the fuselage in proximity to the front end of the fuselage in a direction opposite to the air propelled by the hair dryer.

This embodiment according to which the air inlet is located, like the air outlet, on the side of the front end of the fuselage of the hair dryer allows a large extension of the acoustic path covered by the air. Further, the hair dryer then has no longer any aperture on the rear, with which protection of the user may be ensured. It is noted here that the blown flux should remain predominant over the sucked-up flux in order to avoid suction of elements located in proximity to the air outlet, notably hair.

According to an advantageous implementation of this embodiment, the plastic shell comprises a first so-called internal fuselage from which the air outlet opens out at the front end, this first internal fuselage being intended to be partly covered over its rear portion by a second so-called covering fuselage of greater dimensions and borne by the internal structure bearing the shaft of the fan, the front end of the covering fuselage embodying the air inlet of the hair dryer between both internal and covering fuselages, on the periphery of the internal fuselage.

The thereby obtained extension of the acoustic path is particularly significant since it is possible to cause circulation of the air all along the internal fuselage before it is redirected in the other direction so as to flow out once it is heated, from the inside of the internal fuselage.

For the last three embodiments, baffle, spiral and double fuselage, the conformation of the plastic shell is further advantageously profiled in order to reduce the generation of turbulences and therefore reduce the noise associated with their presence in the flow. The calculation of such a profile is performed by studying the flow lines which then have to be obtained as laminar as possible. The presence of a baffle, spiral or a double fuselage necessarily already allows reduction of certain turbulences by a specific structure, but, advantageously the exact conformation of the plastic shell will advantageously be calculated so as to optimally reduce the turbulences. The plastic shell then combines two functions for a single and same conformation, the first being the extension of the acoustic path and the second the reduction in the generation of turbulences.

In a preferential embodiment, the conformation of the plastic shell is achieved by molding.

With this application it is possible to ensure very good cohesion of the whole of the paths in which air circulates and absence of deterioration of the materials since the paths are directly achieved with the plastic material of the plastic shell.

Further, molding allows considerable latitude as regards a compatible shape, both with the optimization of the conformation of the shell for extending the acoustic path and reducing the turbulences.

In an improved embodiment of the invention, the hair dryer comprises means for preheating the air on the extended acoustic path covered by the air.

Such preheating means may be implemented for example within the baffle front or within the lip in the second embodiment, at the windings of the spiral channels in the fourth embodiment and in the wall of the internal fuselage in the last embodiment. In particular, a motor installed in an isolation chamber within a baffle front according to the invention is a source of heat and may be used as preheating means.

SHORT DESCRIPTION OF THE DRAWINGS

Other features and advantages of the present invention will become apparent from the description made below, with reference to the appended drawings which illustrate an exemplary embodiment thereof without any limitation. In the figures.

DETAILED DESCRIPTION OF AN EMBODIMENT

Figure 1:
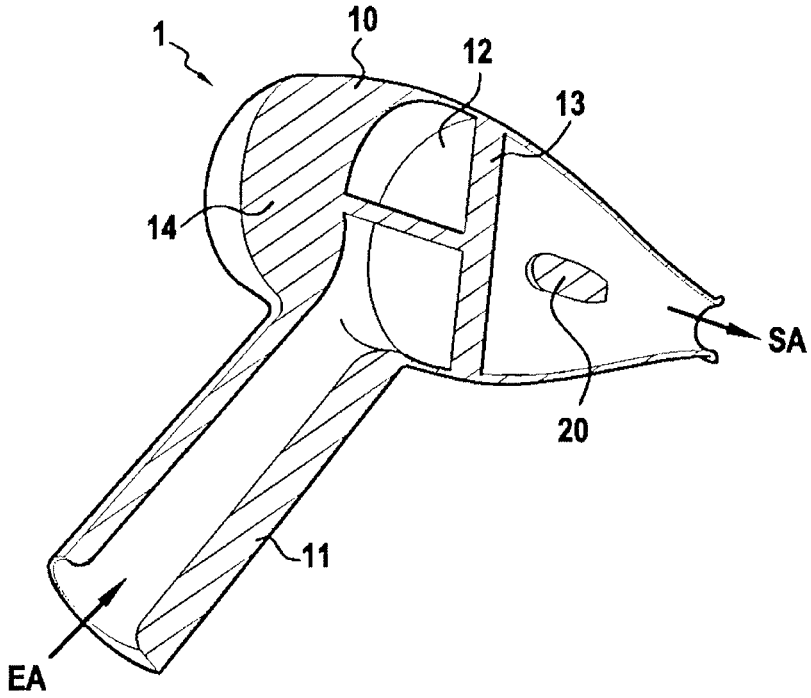
FIG. 1 shows a perspective view of a first embodiment of the invention.

FIG. 1 schematically illustrates a first embodiment of a hair dryer 1 comprising a plastic shell 10 and a stem 11 forming a handle. According to the conventional operation of a hair dryer, the plastic shell 10 comprises an air inlet EA and an air outlet SA. In this embodiment, the air inlet EA illustrated by an arrow is made at the end of the handle stem 11.

On the air circuit, a space 12, also called a suction chamber, is then found, preceding an internal structure 13 bearing a fan not shown which pulses the air towards the air outlet SA also illustrated by an arrow. Conventionally and in the whole of the embodiments shown, heating means 20 are placed on the path of the air pulsed by the fan. These preheating means are advantageously profiled as illustrated in FIG. 1 in order to limit the generation of turbulences and therefore the generation of noise. This is all the more important since a rise in temperature increases the generation of turbulences.

In this embodiment, the motor is advantageously placed in a plastic cap noted as 14 present at the rear end of the hair dryer 1.

Figure 2A:
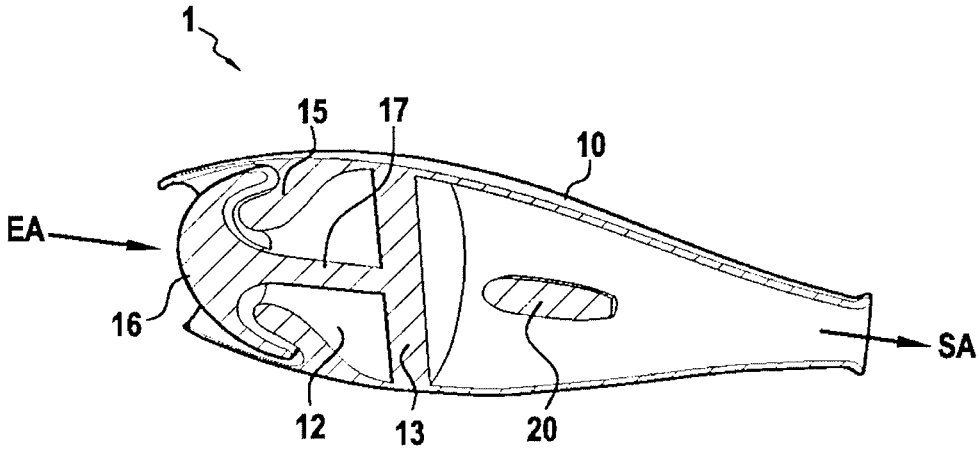
FIGS. 2A and 2B show two alternatives of a same second embodiment of the invention.
Figure 2B:
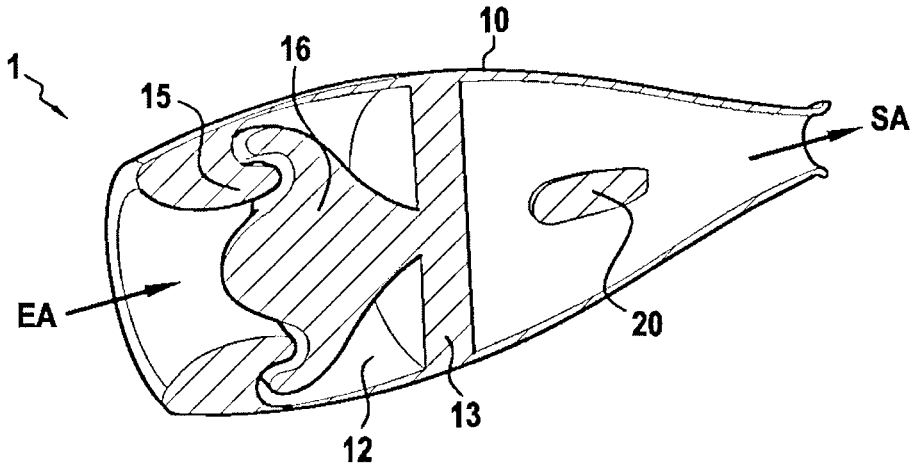

FIGS. 2A and 2B illustrate two alternatives of a same second embodiment of a hair dryer according to the invention. The hair dryer 1 here comprises a tapered plastic shell 10 with an air inlet EA and an air outlet SA. The air inlet EA is placed at the rear end of the fuselage 10. Before a space 12, also called a suction chamber, preceding an internal structure 13 bearing a fan 13, a baffle is directly conformed by molding of the actual plastic shell. This baffle is made by specific molding of a profile on the internal face of the fuselage 10 and of a mating profile at an internal projection of the plastic shell 10 borne by the internal structure 13 bearing the fan, both of these moldings being achieved with rotational symmetry.

Thus, on the internal face of the fuselage 10 is molded a lip 15 with rotational symmetry turned towards the rear of the fuselage. This lip 15 has a profile mating a baffle front 16, acting as a protective cap at the rear end of the fuselage 10. The baffle front 16 is connected through an axial element 17 to the internal structure 13 which bears the fan. The baffle front 16 is a sort of partial plug of the air inlet EA at the rear of the fuselage 10.

In FIG. 2A, the obtained air inlet ring-shaped path between the lip 15 and the front 16 is therefore staggered since the presence of the baffle front 16 forces the air to abut upon the perimeter of the lip 15 at its connection to the fuselage 10. Next, the air is brought back towards the rear of the fuselage 10 by the lip 15 before being propelled into a space 12, also called a suction chamber, preceding the internal structure 13.

The embodiment shown in FIG. 2B has a lip 15 oriented in the opposite direction to the lip 15 shown in FIG. 2A, i.e. a lip 15 with rotational symmetry oriented towards the front of the hair dryer.

A baffle front 16 then has the mating profile. In the alternative of FIG. 2B, the presence of the lip 15 urges the air to abut in a ring-shaped bottom made on the baffle front 16. And then the profile of the baffle front 16 mating the profile of the lip 15 causes air to circulate towards the rear of the fuselage 10 so as to come into contact with the ring-shaped bottom of the lip 15 located at the periphery of the latter at the connection of the lip 15 to the fuselage. Finally the air is again propelled forwards inside the space 12, a so-called suction chamber, preceding the internal structure 13.

The configuration 2B is particularly performing since it generates very little pressure drop and appeases the turbulences very well. Indeed, it allows a perfectly laminar flow to be obtained.

Figure 3:
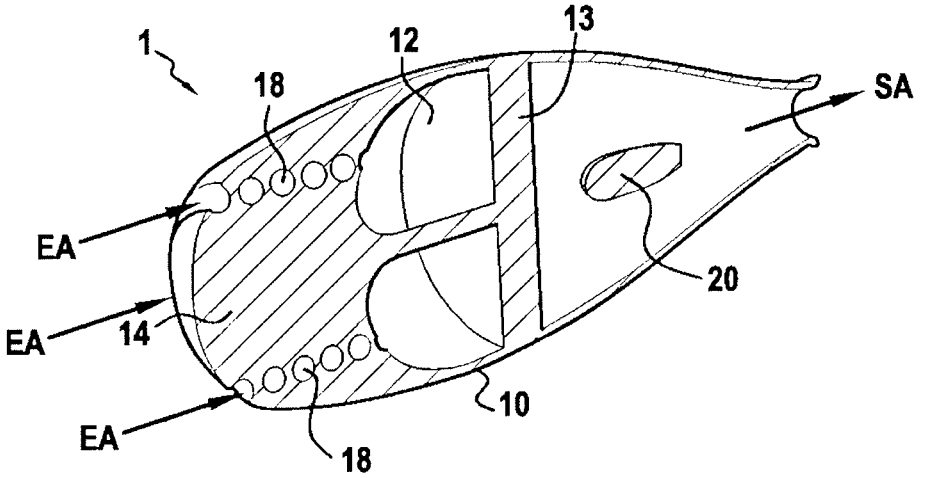
FIG. 3 shows a third embodiment.

FIG. 3 represents a third embodiment of the invention according to which the plastic cap 14, placed at the rear end of the plastic shell 10, is pierced with at least one spiral channel 18 and preferably with several spirals, here four spirals. The air inlet EA then consists of the inlet(s) of this(these) spiral(s). The air then circulating in its spirals sees its acoustic path extended as compared with the direct rectilinear path of an inlet placed at the rear end of the fuselage 10 and the space 12.

Circulation of air in the spirals 18 is laminar circulation of air which avoids generation of turbulences and the associated noise. Moreover, by multiplying the number of spirals, it is possible to limit the pressure losses. This allows the use of a not very large spiral channel diameter while ensuring that the pressure losses are not significant. In any case, by using a suitable spiral channel diameter with a suitable number of spirals it is possible to not observe any pressure drop or observe minimal pressure drops.

Advantageously, in this embodiment, a motor actuating the fan will be placed inside the cap 14, optionally on suspensions, for example passive dampers (<<silent blocks>>) for decoupling the turbine from the plastic shell and thereby avoiding resonances.

More generally and totally independent of the invention as claimed, the motor case will advantageously be decoupled from the body of the hair dryer, here formed by the plastic shell. This decoupling is advantageously achieved by suspension. The use of passive dampers at the points for holding the motor case thus allows reduction in the noise due to solids, moreover perceived at the stem.

Moreover, it is also possible to use a ring-shaped gasket around the internal structure 13 bearing the fan or around the actual fan in order to decouple the vibrations of the fan and of the shell 10.

In order to heat up the air, the heating means, for example resistors, may also be placed in proximity to the spiral channels on the path of the air.

Figure 4:
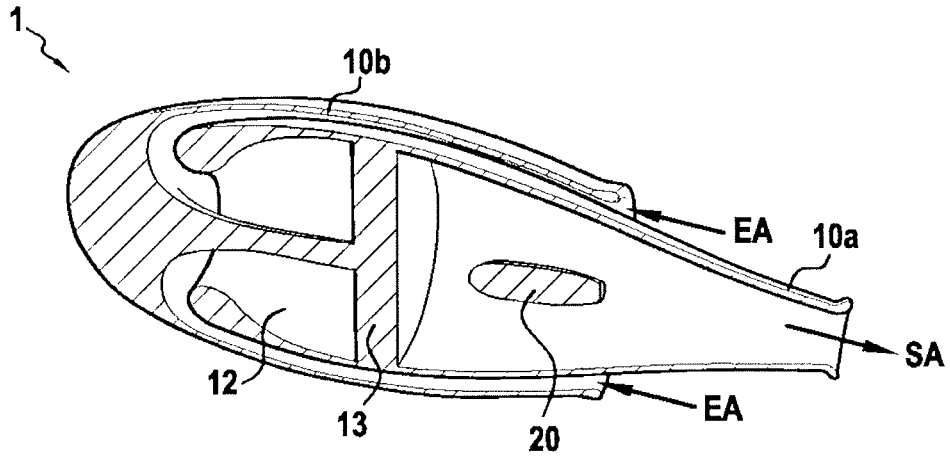
FIG. 4 shows a fourth embodiment of the invention.

FIG. 4 illustrates a last embodiment of the invention according to which the air inlet EA is distributed over the contour of an internal fuselage 10*a* around which a covering fuselage 10*b* is encased.

Advantageously, as illustrated in FIG. 4, the fuselage 10*b* is connected to the fuselage 10*a* via the internal structure 13 bearing the fan.

In this case, the air covers the distance between the air inlet EA and an internal space 12, forming a suction chamber, delimited at the rear of the internal fuselage 10*a*.

Thus, the air having circulated over the perimeter of the internal fuselage 10*a* passes to the rear end of the hair dryer before entering the space 12, passing through the fan 13 and before being expelled from the hair dryer through the air outlet SA, while having passed over the heating means 20.

It is noted here again that the circulation of the air between both covering and internal fuselages is laminar circulation which reduces the generation of turbulences and the associated noise. The specific profiling of the extended acoustic path gives the possibility of adding reduction in turbulence phenomena to the moving-away of the sound source. This combination of two sound reduction functions obtained with a specific profiling is typical of the invention and is encountered for all the embodiments except for the first which only proposes an extension of the acoustic path.

Figure 5:
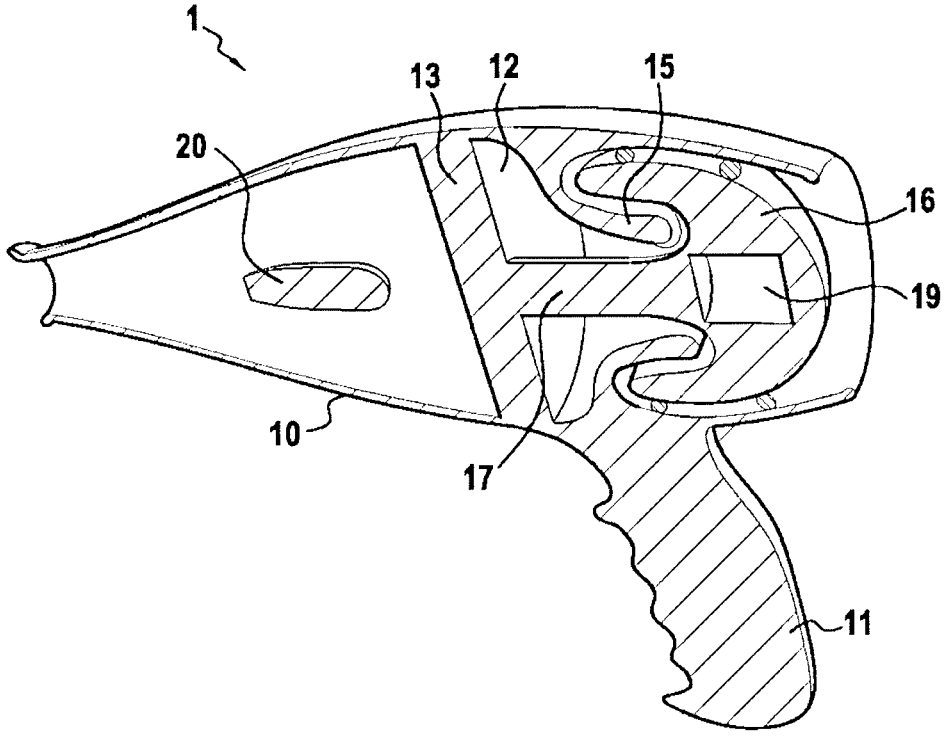
FIG. 5 shows an improvement of the second embodiment of the invention.

FIG. 5 shows an improvement of the embodiment of FIGS. 2A and 2B.

In this improvement, a chamber for isolating the motor is placed in the baffle front 16, this chamber for isolating the motor 19 allows, since the baffle front 16 is partly mounted suspended by the axial structure 17 relatively to the plastic shell, isolation of the vibrations of the motor of the latter.

Advantageously this isolation chamber 19 is connected to the space 12 preceding the internal structure 13, also called a suction chamber, through heat pipes. This not only allows cooling of the motor but also preheating of the air.

Finally it is noted that various applications may be achieved according to the principles of the invention. In particular, it is noted here that in the provided figures, the shell 10 is made as a single piece between the elements making up the fuselage and the elements making up the internal structure 13 bearing the fan. Nevertheless it is quite possible that these molded elements be made separately and then assembled so as to form a hair dryer as illustrated in the figures shown, without such an embodiment departing from the principles of the invention.

The invention claimed is:

1. A hand-held hair dryer comprising:

a tapered plastic shell comprising:

at least one air inlet, a front end comprising an air outlet and configured to be directed towards the hair to be heated, a rear end, at least one fan comprising a shaft borne by an internal structure of the shell and attached in a central portion of the shell, a motor to drive the fan, and heating means arranged in the air path between the air inlet and the air outlet, wherein the fan brings in air from the at least one air inlet and expels heated air out through the air outlet, and wherein:

all of the air expelled through the air outlet flows a distance between the air inlet and the internal structure bearing the fan such that it is greater than the physical distance between the rear end and the internal structure bearing the fan.

2. The hair dryer of claim 1, wherein the hair dryer further comprises a handle forming a lateral projection on the tapered shell and the air inlet is arranged at the distal end of the handle.

3. The hair dryer of claim 1, wherein the air inlet is placed at the rear end of the shell, and the hair dryer further comprises:

an internal space arranged between the rear end and the internal structure, an internal face molded so as to form a lip with rotational symmetry, a baffle front end molded with rotational symmetry, such that the facing profiles of the baffle front end and lip are complementary, the baffle front end being arranged in a central orifice of the rear end of the shell and borne by the internal structure supporting the shaft of the fan, the baffle front end and lip having their facing profiles being spaced from each other such that a baffle through which air may flow is formed between the air inlet and the internal space.

4. The hair dryer of claim 3, wherein the baffle front borne by the internal structure includes a suspension chamber in which the motor is placed.

5. The hair dryer of claim 1, further comprising:

an internal space preceding the internal structure, a cap of plastic material arranged at the rear of the shell, and at least one spiral pierced in the cap, this spiral opening out into the internal space, the inlet of the spiral forming the air inlet of the hair dryer.

6. The hair dryer of claim 5, wherein at least two spirals are pierced in the cap and open out into the internal space, the inlets of the spirals being the air inlet of the hair dryer.

7. The hair dryer of claim 1, wherein the air inlet is located on the periphery of the shell in proximity to the front end of the shell such that the air brought in by the fan flows in a direction opposite to the air propelled by the hair dryer out of the air outlet.

8. The hair dryer of claim 7, wherein the plastic shell comprises a first fuselage comprising a front portion forming the air outlet at the front end of the hair dryer and a rear portion towards the rear end of the hair dryer, a second fuselage comprising a front portion arranged towards the front end of the hair dryer and a rear portion at the rear end of the hair dryer, wherein the second fuselage surrounds the rear portion of the first fuselage, the second fuselage being borne by the internal structure bearing the shaft of the fan, and wherein a space is formed, towards the front end of the hair dryer, between the internal face of the second fuselage and the external face of the first fuselage, the space forming the air inlet of the hair dryer.

9. The hair dryer of claim 1, wherein the conformation of the plastic shell is made by molding.

10. The hair dryer of claim 1, further comprising means for preheating the air placed between the air inlet and the internal structure.

11. The hair dryer of claim 1, wherein the air flow between the air inlet and the internal structure is laminar.

* * * * *